US005850054A

United States Patent [19]

Bonmann et al.

[11] Patent Number: 5,850,054

[45] **Date of Patent: *Dec. 15, 1998**

[54] DIVISION OF CURRENT BETWEEN DIFFERENT STRANDS OF A SUPERCONDUCTING WINDING

[75] Inventors: Dietrich Bonmann, Meckenheim, Germany; Sven Hörnfeldt, Västerås, Sweden

[73] Assignee: Asea Brown Boveri AB, Vasteras, Sweden

[ * ] Notice: The term of this patent shall not extend beyond the expiration date of Pat. No. 5,720,193.

[21] Appl. No.: 428,139

[22] PCT Filed: Nov. 1, 1993

[86] PCT No.: PCT/SE93/00910

§ 371 Date: May 17, 1995

§ 102(e) Date: May 17, 1995

[87] PCT Pub. No.: WO94/12994

PCT Pub. Date: Jun. 9, 1994

[30] Foreign Application Priority Data

Nov. 30, 1992 [SE] Sweden ..... 9203592

[51] Int. Cl.[6] ..... H01F 36/00

[52] U.S. Cl. ..... 174/15.4; 336/216

[58] Field of Search ..... 174/15.4, 15.5; 505/220, 230, 875; 336/216; 62/51.1, 259.2

[56] References Cited

U.S. PATENT DOCUMENTS 4,447,670 5/1984 Eckels ..... 174/15.4

OTHER PUBLICATIONS

K. Funaki et al., Development of a Large–Capacity . . . Transformers, IEEE Transactions on Magnetics, vol. 28, No. 1, Jan. 1992, pp. 394–397.

M.N. Wilson, Superconducting Magnets, 1983, pp. 256–273.

*Primary Examiner*—Hyung S. Sough

*Attorney, Agent, or Firm*—Watson Cole Grindle Watson, P.L.L.C.

[57] ABSTRACT

A connection arrangement between superconducting strands of a winding located in a cryotank with strands located external thereof is disclosed. Current leads inside the cryotank are mutually insulated by spacers and current leads outside the cryotank are grouped and interconnected into corresponding single current leads.

4 Claims, 1 Drawing Sheet

DIVISION OF CURRENT BETWEEN DIFFERENT STRANDS OF A SUPERCONDUCTING WINDING

TECHNICAL FIELD

In the application of the superconducting effect, the object whose electrical conductors in this application consist of a number of strands of a winding, is normally disposed in a so-called cryotank. In the lower part of the cryotank the refrigerant is arranged in the form of a cryogenic liquid surrounding the object. The space of the cryotank above the liquid level is occupied by the refrigerant in gaseous state. The electric current connection to the object is performed via current leads in bushings which via fixing flanges are connected to the lid of the cryotank. The invention relates to a connection arrangement between the strands of the winding and the current leads in a.c. applications which ensures a good division of current between the strands.

BACKGROUND ART, THE PROBLEMS

The conductors in reactor or transformer windings are often divided into a plurality of strands insulated from each other to minimize the unfavourable effects of the skin effect. Even if the strands are well transposed, there will always be a certain variation in the induced voltage since the different strands do not surround an exactly equally great magnetic flux. This, in turn, leads to the current distribution between the different strands becoming uneven, whereby the so-called copper losses increase. The resistance of the strands, however, has a stabilizing effect on the current distribution since the strands in which the induced voltage is greatest will have the largest currents and hence also the greatest resistive voltage drops.

Now, if such a winding consists of a plurality of superconducting strands, the stabilizing resistive voltage drops will be negligible. Since the prior art—see, for example, an article entitled "Development of a Large-Capacity Superconducting Cable for 1000 kVA-Class Power Transformers", IEEE TRANSACTIONS ON MAGNETS, VOL. 28, NO. 1, January 1992, pages 394–397 (especially page 397 and FIG. 7)—comprises electrically connecting the strands of the winding to each other at the terminals of the winding, the variation in the induced voltage may give rise to a great variation in the current distribution. The strand which has to carry the largest current may then risk arriving at a state in which it loses its superconducting ability because the critical current density is exceeded. This leads to an unwanted local heating.

However, a corresponding problem does not arise in d.c. applications with superconducting strands, for example in connection with magnets. The reason for this is that, in steady state, no voltage is induced which may give rise to variation in the current distribution and that current changes take place with a very low time rate of change.

A problem which arises in connection with superconducting applications is the heat influx to the cryogenic liquid which takes place because of the temperature difference between the surroundings and the object. This is due to the fact that the current leads of the bushing, besides being good electric conductors, are also good thermal conductors. In addition, at least at high currents, heat is developed in the current leads of the bushing due to the current which flows through the current leads. The electric heat generation takes place as a result of the ohmic resistance in the current leads. In case of alternating current, there is also the generation of heat because of the occurrence of eddy currents. The increased resistance arising because of the skin effect must also be taken into account. The gas developed because of the heat influx to the cryotank is allowed, via an opening on that part of the bushing which is located outside the cryotank, to flow freely out into the surroundings.

The above means that a gas flow, which at the interface between liquid and gas largely maintains the temperature of the liquid, on its way up to the lid and the discharge into the surroundings, where it assumes the temperature of the surrounding air, flows around the current leads and hence can be used for cooling thereof. Since the direction of the gas flow is opposite to the heat influx, this gas cooling is often called counter-flow cooling. To make it as efficient as possible, the current leads are designed as heat exchangers. As such, the current leads in the gas-filled part of the cryotank may have various designs. In Superconducting Magnets, Clarendon Press, Oxford 1983, page 272, the current leads are described as electrically parallel-connected foils which are mounted at a certain distance from each other for passage of a refrigerant along the foils. The package of foils is placed in a tubular surrounding casing of insulating material with an inner open space with a rectangularly formed cross section. Our patent application entitled "Gas-cooled bushing for superconducting applications", filed concurrently with the present application, describes a cooling device which also utilizes the gas flow for cooling of the current leads which in this case consist of a number of plate-formed sub-leads with intermediate insulated transverse ribs which form spiral cooling channels around and between the sub-leads. Outside the cryotank the sub-leads change into a solid current lead. According to the state of the art, described, inter alia, in Superconducting Magnets, the sub-leads are electrically interconnected at the terminals of the winding.

SUMMARY OF THE INVENTION, ADVANTAGES

As is clear from the above, non-superconducting conductors have a certain stabilizing effect on the current distribution between the closed circuits which are formed from the different strands interconnected at the terminals of the winding because of the resistive voltage drops in the strands. When the strands consist of superconductors, on the other hand, the stabilizing effect is negligible.

For reasons of cooling and to minimize the effects of the skin effect, therefore, according to the above the current leads in the bushing have been divided into a number of sub-leads either in the form of foil or plates. These sub-leads are then interconnected again at the terminals of the winding for all the strands of the winding. As will also be clear from the above, a certain electric heat generation takes place in the current leads of the sub-leads of the bushing due to the ohmic resistance thereof.

The invention now comprises allowing the current leads in the bushing to have as many sub-leads, insulated from each other, in the form of foils or plates as there are strands, insulated from each other, in the winding and connecting the ends of each strand to a sub-lead in each one of the current leads of the bushing. The electrical interconnection of the strands of the winding will thus take place immediately above the cryotank where the sub-leads change into a solid conductor. In this way the strand circuits, that is, the circuits which are formed from the strands and the respective sub-leads, will comprise a certain ohmic resistance which emanates from the sub-leads in the two current leads. This, in turn, means that also in a winding with superconducting strands there will be a stabilizing effect on the current distribution between the various strands.

Since the winding consists of many superconducting strands, it may be impractical to have as many sub-leads in the current leads of the bushing as there are strands in the winding. The invention therefore also comprises dividing the number of strands in the winding into as many groups as there are sub-leads in the current leads of the bushing and allowing each group to contain an equal number of strands. This means that also in such a case a considerable stabilizing effect on the current distribution is obtained.

DESCRIPTION OF THE PREFERRED EMBODIMENTS

The embodiment of a cryotank is in general dependent on the shape and size of the object which is to assume such a temperature that the electrical conductors associated with the object become superconducting. The bushings with their current leads, however, are practically always placed on the lid of the cryotank. However, the location on the lid where the bushing is placed can vary depending on the object in question.

Figure 1:
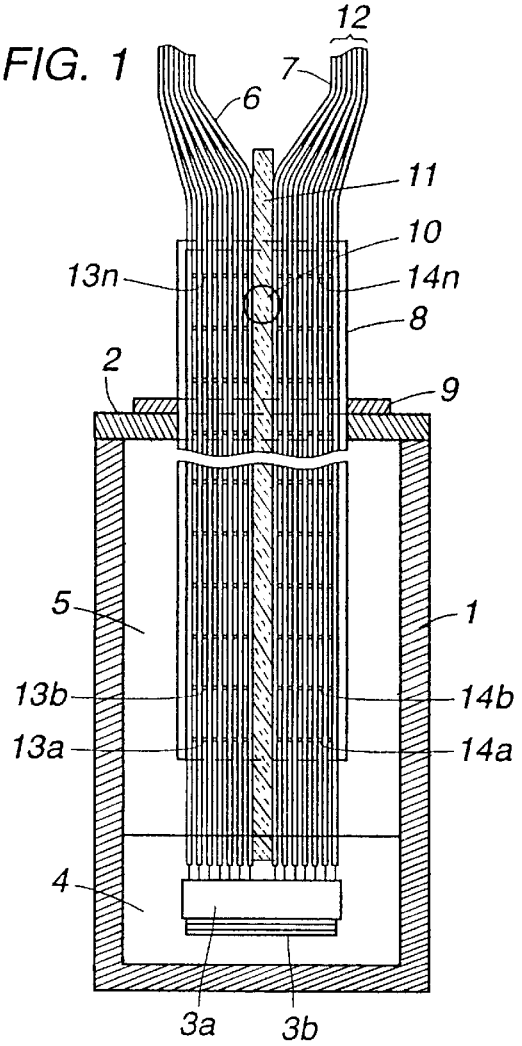
FIG. 1 shows a section of a cryotank with the embodiment of the connection arrangement inside the cryotank.
Figure 2:
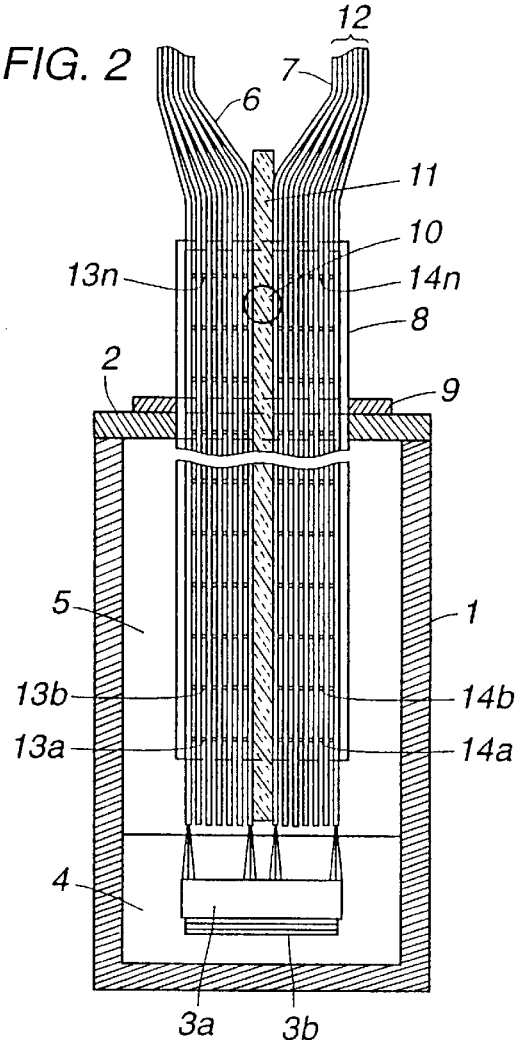
FIG. 2 shows an alternative embodiment of the connection arrangement inside a cryotank in accordance with the invention.

FIGS. 1 and 2 show a section of a cryotank with a bushing placed centrally in the lid. The figures, which comprise embodiments with two current leads, show the cryotank 1, the lid 2, the object 3, here shown in the form of the winding 3*a* consisting of the transposed strands and the yoke 3*b*, the cryogenic liquid 4, the refrigerant in gaseous state 5, the current leads 6 and 7, the casing 8 of the bushing surrounding the current leads with the fixing flange 9, and an opening 10 for the gas discharge.

Figure 3:
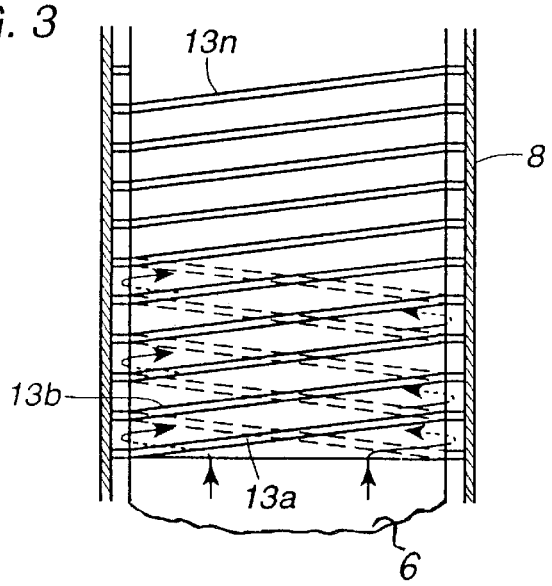
FIG. 3 shows a section of the current leads in a cryotank in a plane perpendicular to the section according to FIGS. 1 and 2.

The figures also shows the insulation 11 present between the current leads and that the current leads consist of a number of plate-formed sub-leads 12. Above the cryotank these sub-leads are retained so as to form a more or less solid current lead. Both for reasons of cooling and other reasons, it is desirable to keep the sub-leads at a certain distance from each other inside the cryotank. To ensure the same distance between the sub-leads and to achieve cooling channels in the space between each sub-lead as well as mechanical stability, as is clear from the figures a number of rows of transverse ribs 13*a*, 13*b*, . . . 13*n* of insulating material are placed between the sub-leads of the current lead 6 and the corresponding transverse ribs 14*a*, 14*b*, . . . 14*n* of the current lead 7. The location of the transverse ribs and the cooling channels are clear from FIG. 3 which show the current leads in a plane perpendicular to the plane according to FIGS. 1 and 2.

In a preferred embodiment according to FIG. 1, the winding consists of just as many strands as there are sub-leads in the current leads of the bushing, that is, one strand is connected to the end of each sub-lead. However, because of the insulating transverse ribs between the sub-leads, the strands will not be electrically interconnected until the sub-leads are interconnected outside the cryotank.

We claim:

1. A connection arrangement for connecting individual superconducting strands of a winding locatable in the lower part of a cryotank containing a supply of cooling liquid with solid conductor current leads locatable outside the cryotank wherein the winding is to be immersed in the cooling liquid, and wherein an upper part of the cryotank is to be filled with a gas comprising: a plurality of grouped sub-leads and a main insulation separating a first group of said sub-leads from a second group of said sub-leads and wherein the sub-leads locatable inside the upper part of the cryotank include spacers comprising a plurality of rows of insulating transverse ribs of uniform size located between the sub-leads for providing a corresponding uniform space therebetween.

2. The connection arrangement according to claim 1, wherein an individual sub-lead is connectable to a corresponding one of said strands.

3. The connection arrangement according to claim 1, wherein an individual sub-lead is connectable to a number of strands.

4. An apparatus for effecting a connection between corresponding groups of individual superconducting strands of a winding and solid conductors, said winding being locatable in a lower part of a cryotank to be filled with a cooling liquid and solid conductors being locatable outside the cryotank comprising: sub-leads locatable in an upper part of the cryotank filled with gas, said sub-leads being separated into groups corresponding the solid conductors and a main insulation locatable in the cryotank for separating the groups of sub-leads, the sub-leads locatable inside the cryotank being arranged in a plurality of equally spaced rows and insulating transverse ribs located between the rows.

* * * * *